US009039112B2

(12) United States Patent
Murayama et al.

(10) Patent No.: US 9,039,112 B2
(45) Date of Patent: May 26, 2015

(54) INKJET PRINTING APPARATUS FOR CHANGING A RANGE OF USED EJECTION PORTS ACCORDING TO EJECTION PORT USAGE

(75) Inventors: Yoshiaki Murayama, Tokyo (JP); Takeshi Murase, Yokohama (JP); Masao Kato, Kawasaki (JP); Shigeyasu Nagoshi, Yokohama (JP); Minoru Teshigawara, Saitama (JP); Minako Kato, Kawasaki (JP); Susumu Hirosawa, Tokyo (JP); Yutaka Kano, Yokohama (JP); Satoshi Azuma, Kawasaki (JP); Kentarou Muro, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 98 days.

(21) Appl. No.: 12/964,085

(22) Filed: Dec. 9, 2010

(65) Prior Publication Data

US 2011/0298849 A1 Dec. 8, 2011

(30) Foreign Application Priority Data

Jun. 3, 2010 (JP) ..... 2010-128047

(51) Int. Cl.

| | |
|---|---|
| ***B41J 29/38*** | (2006.01) |
| ***B41J 25/00*** | (2006.01) |
| ***B41J 2/21*** | (2006.01) |
| *B41J 2/175* | (2006.01) |

(52) U.S. Cl.

CPC ..... *B41J 25/001* (2013.01); *B41J 2/2146* (2013.01); *B41J 2002/17569* (2013.01)

(58) Field of Classification Search

None

See application file for complete search history.

(56) References Cited

U.S. PATENT DOCUMENTS

| | | | | |
|---|---|---|---|---|
| 5,739,828 | A | 4/1998 | Moriyama et al. | |
| 5,980,012 | A | 11/1999 | Fujita et al. | |
| 6,309,051 | B1 | 10/2001 | Koitabashi et al. | |
| 6,325,492 | B1 | 12/2001 | Koitabashi et al. | |
| 6,572,216 | B1 | 6/2003 | Koitabashi et al. | |
| 6,594,028 | B1 * | 7/2003 | Hamamoto et al. | 358/1.15 |
| 6,918,656 | B2 | 7/2005 | Koitabashi et al. | |
| 7,425,056 | B1 | 9/2008 | Koitabashi et al. | |

(Continued)

FOREIGN PATENT DOCUMENTS

| | | | |
|---|---|---|---|
| JP | 2004-276387 | A | 10/2004 |
| JP | 2005-297444 | A | 10/2005 |
| JP | 2005-297510 | A | 10/2005 |

(Continued)

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

In a line-head type inkjet printing apparatus that ejects a plurality of types of inks, an inkjet printing apparatus is provided in which the change of its ejection properties different depending on the type of ink is prevented from occurring. The line-head type printing apparatus includes an acquisition unit that counts the ejection number of liquid from each of print heads in each of a plurality of print heads. Furthermore, the printing apparatus compares the ejection number of liquid from each of the print heads counted by the acquisition unit with a threshold value set for each of the print heads. The printing apparatus includes a change unit that can move a holder in the main scanning direction when the counted ejection number of liquid exceeds the threshold value set for the print head.

15 Claims, 7 Drawing Sheets

(56) References Cited

U.S. PATENT DOCUMENTS

| | | | | |
|---|---|---|---|---|
| 7,547,085 | B2 * | 6/2009 | Yagi et al. | 347/16 |
| 2010/0156981 | A1 | 6/2010 | Chikuma et al. | |

FOREIGN PATENT DOCUMENTS

| | | | | |
|---|---|---|---|---|
| JP | 2005297510 | A * | 10/2005 | B41J 2/01 |
| JP | 2007-130974 | A | 5/2007 | |

* cited by examiner

INKJET PRINTING APPARATUS FOR CHANGING A RANGE OF USED EJECTION PORTS ACCORDING TO EJECTION PORT USAGE

BACKGROUND OF THE INVENTION

1. Field of the Invention

The present invention relates to an inkjet printing apparatus, and more particularly relates to an inkjet printing apparatus which includes a print head having a plurality of ejection ports arranged in a direction intersecting with the direction in which a print medium is conveyed and which ejects ink from the ejection port to perform printing.

2. Description of the Related Art

As one type of inkjet printing apparatus that ejects droplets (ink) from a print head to perform printing, a line head type inkjet printing apparatus is known. The line head type inkjet printing apparatus includes a print head having a plurality of ejection ports arranged and formed in a direction intersecting with the direction in which a print medium is conveyed. With the print medium conveyed in the direction intersecting with the direction in which an ejection port array extends, the droplets are ejected from the ejection ports of the print head on the print medium to perform printing. In the line head type inkjet printing apparatus, droplets used for printing for one line are ejected from the print head at one time, and such printing is continuously performed. Therefore, the line head type inkjet printing apparatus has an advantage in that its printing speed is high.

In this line head type inkjet printing apparatus, printing can be performed on print media having various widths as long as their widths are equal to or less than the length corresponding to the portion where the ejection ports in the print head are formed. However, since the line head type inkjet printing apparatus continuously performs printing on print media having widths that are narrower than the length of the portion where the ejection ports are formed, some of the ejection ports are repeatedly used for the ejecting and some other ejection ports are seldom used for the ejecting.

In general, a printing element that applies energy to liquid stored in a print head to eject droplets from ejection ports has a lifetime, and the number of times the printing element is driven is limited. When the same printing element is continuously driven to continuously eject droplets through the same ejection port, the life of the printing element is shortened. Moreover, when droplets are repeatedly ejected from the same ejection port, it is know that, before the printing element reaches the end of its life, the ejection properties (ejection amount) of droplets ejected from the ejection port are changed. Hence, Japanese Patent Laid-Open No. 2005-297510 discloses an inkjet printing apparatus in which, every predetermined number of sheets printed, a print head is moved in a direction intersecting with the direction in which the print medium is conveyed, and thus ejection ports to be used for printing are changed. This inkjet printing apparatus is used to perform printing, and thus ejection ports used for the printing can be distributed, and the number of times each ejection port is used is made uniform.

However, a case that a large amount of particular type of ink is only consumed, depending on a printed image, can be considered. In this case, a large amount of a particular type of ink is only ejected even though a small number of sheets are printed, and thus a printing element arranged in a print head that ejects the specific type of ink may only be used repeatedly. Here, in the printing apparatus disclosed in Japanese Patent Laid-Open No. 2005-297510, since the print head is not moved because a small number of sheets are printed, the ejection properties of the particular type of ink may be changed. Therefore, when printing is performed on a print medium larger than the print medium that has been used, the density of a specific color may differ between a region corresponding to the width of the print medium on which the printing has been performed and a region outside the above-mentioned region. The occurrence of this density difference may cause the quality of a printed image to be reduced.

SUMMARY OF THE INVENTION

In view of the foregoing circumstances, the present invention has an object to prevent from degrading a quality of printed image occurred by unbalanced frequency of using of ejection port, in a line head type inkjet printing apparatus which ejects a plurality of types of inks.

According to an aspect of the present invention, there is provided an inkjet printing apparatus comprising: a printing unit configured to use a plurality of print heads for ejecting respective different inks and perform printing on a print medium by ejecting ink from part of a plurality of ejection ports included in the print heads; an acquisition unit configured to acquire an accumulative ejection number of ink every predetermined number of ejection ports in at least one of the plurality of print heads; and a change unit configured to change a range of use of ejection ports of at least one print head when a value relating to the accumulative ejection number in a range of use of ejection ports of the at least one print head for performing the printing on the print medium is greater than a predetermined threshold value.

According to the inkjet printing apparatus of the present invention, in a line head type inkjet printing apparatus having a plurality of print heads, it is possible to prevent the frequency of ejection from being different depending on regions, for each of the print heads. Therefore, it is possible to prevent the change of the ejection properties from occurring depending on regions only by a particular print head among a plurality of print heads.

Further features of the present invention will become apparent from the following description of exemplary embodiments (with reference to the attached drawings).

DESCRIPTION OF THE EMBODIMENTS

An inkjet printing apparatus according to embodiments of the present invention will be described below with reference to the accompanying drawings.

First Embodiment

Figure 1:
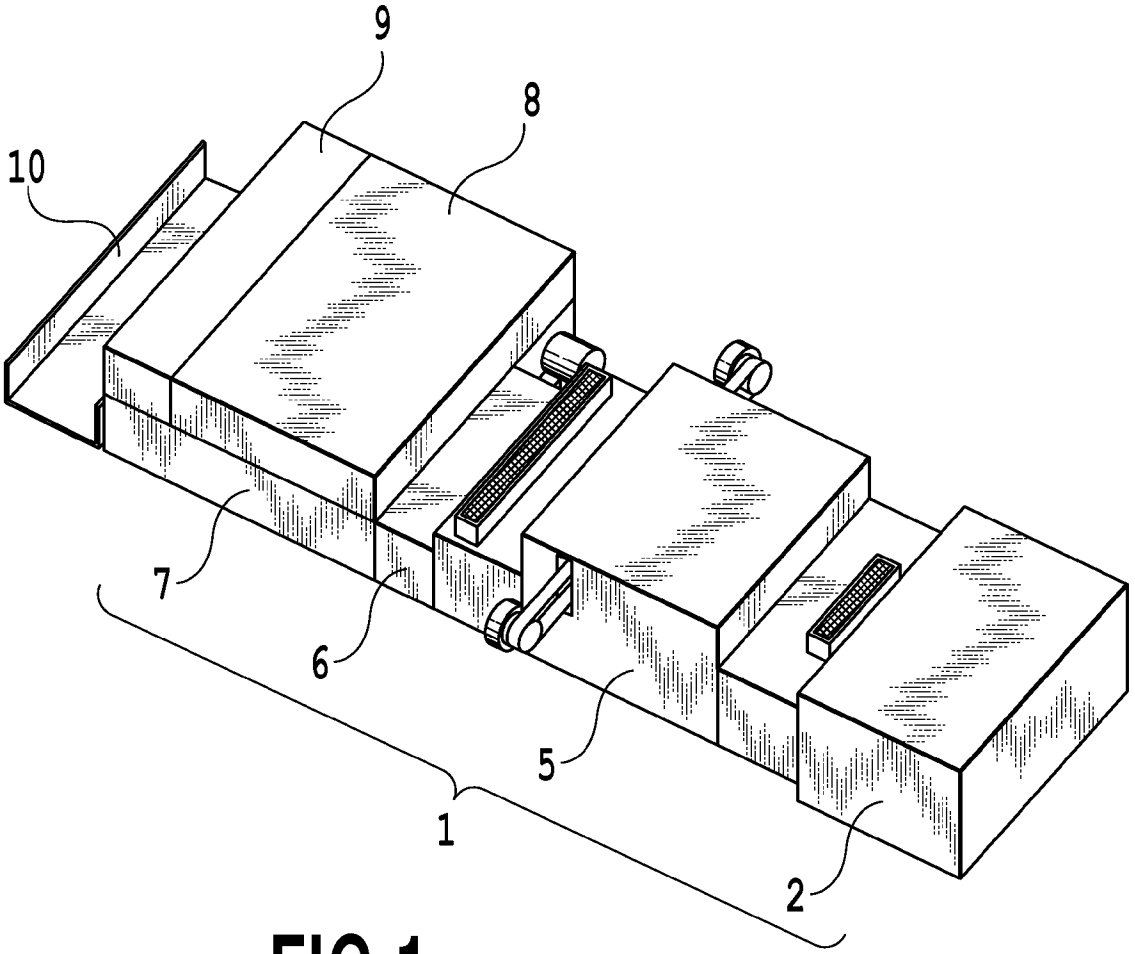
FIG. 1 is a perspective view showing an inkjet printing apparatus according to a first embodiment of the present invention.

FIG. 1 is a perspective view showing the overall configuration of an inkjet printing apparatus according to a first embodiment of the present invention. A printing apparatus 1 includes, as the inkjet printing apparatus, from the upstream side to the downstream side in a conveyance direction of a sheet when the printing on the sheet is performed, a paper feed portion 2, a printing portion 5, a cutter portion 6, a drying portion 7, an ink tank portion 8, a control portion 12 and a paper discharge portion 10.

Figure 2:
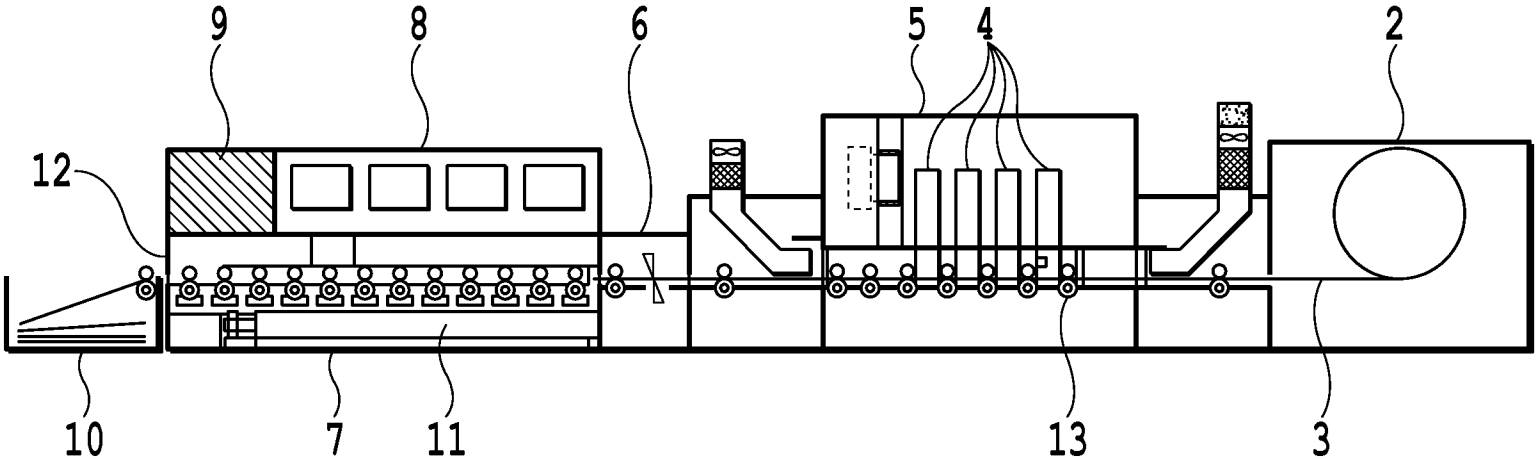
FIG. 2 is a cross-sectional view of the inkjet printing apparatus of FIG. 1.

FIG. 2 is a cross-sectional view showing the internal structure of the printing apparatus 1 of FIG. 1. The paper feed portion 2 rotatably holds a sheet 3 rolled into a cylinder shape. Although the sheet 3 used as a print medium for printing in the present embodiment is continuous paper rolled into a cylinder, cut sheets separated from each other may be applied. The paper feed portion 2 has a feed mechanism for pulling out the sheet 3 and feeding it to the downstream side in the sheet conveyance direction.

The printing portion 5 includes a plurality of print heads 4 corresponding to respective colors such that inks of different colors can be ejected. In each of the print heads 4, a plurality of ejection ports arranged along a main scanning direction intersecting with the conveyance direction in which the print medium is conveyed, is formed. In the present embodiment, the print heads 9 are arranged so that the print medium conveyance direction is perpendicular to the main scanning direction. Liquid is ejected from the ejection ports formed in the print heads 4 to perform printing on the print medium. The printing portion 5 of the printing apparatus 1 has a holder that can mount the plurality of print heads 4.

The plurality of print heads 4 are attached such that each of the print heads 4 extends along the main scanning direction. A plurality of print heads 4 arranged so as to extend in the main scanning direction is arranged in the print medium conveyance direction. As described above, the printing apparatus 1 of the present embodiment performs printing by an inkjet method of ejecting droplets from the print heads, and is a line head type printing apparatus in which an ejection port array is formed in the print head 4 along the main scanning direction. Among the plurality of print heads 4, the positions of each of the print head 4 in the main scanning direction are all the same. The length of each of the print heads 4 in the main scanning direction is 12 inches. In the present embodiment, four print heads 4 corresponding to four colors, namely, C (cyan), M (magenta), Y (yellow) and K (black), are arranged. However, the types of colors of inks ejected by the print heads 4 and the number of colors are not limited.

The inks of each of the colors are supplied via the ink tank portion 8 to the print heads 4 through an unillustrated ink tube. In each of the print heads 4, an ejection port array is formed so as to cover the maximum width of the print medium assumed to be used. As the ejection port array, a plurality of arrays that are regularly arranged such as in a staggered configuration may be formed in the print head 4 along the width direction of the print medium, or one array may be formed in the print head 4 along the width direction of the print medium. As a method of ejecting droplets from the print head 4, a method using a heating element, a method using a piezo element, a method using an electrostatic element, a method using a MEMS element or the like can be employed.

In portions corresponding to the print heads 4 of the printing portion 5, a sheet conveyance path for conveying the print medium intersects with ejection port array of the print heads 4. The printing portion 5 has a conveyance mechanism 13 for conveying a sheet along the sheet conveyance path. The conveyance mechanism 13 includes a plurality of conveyance rollers arranged along the sheet conveyance path and a platen having a support surface that supports the sheet 3 between the adjacent conveyance rollers. These print heads 4, the conveyance mechanism 13 and the platen are housed in a casing 9.

With respect to the ejection ports of the print head, there are two different conditions, one in which the ejection port is in a region (conveyance region) where the sheet as the print medium to be conveyed faces and the other in which the ejection port is in a region (non-conveyance region) where the sheet does not face. In these conditions, the positional relationship and the ratio between the conveyance region and the non-conveyance region are changed according to the width of the print medium that is used.

The cutter portion 6 is a unit for cutting a continuous sheet on which printing has been performed by the printing portion 5 into predetermined sized sheets, and is provided with a cutter mechanism. The drying portion 7 is a unit for drying ink on the sheet in a short period of time. In the drying portion 7, a plurality of conveyance rollers arranged along a heater 11 and the print medium conveyance path is provided. The paper discharge portion 10 is a unit that accommodates the cut sheets having been discharged from the drying portion 7. In the paper discharge portion 10, a plurality of sheets on which printing has been performed is stacked. The control portion 12 is a controller that manages various types of control and driving for the entire printing apparatus 1, and includes a CPU, a memory and various types of I/O interfaces.

Figure 3:
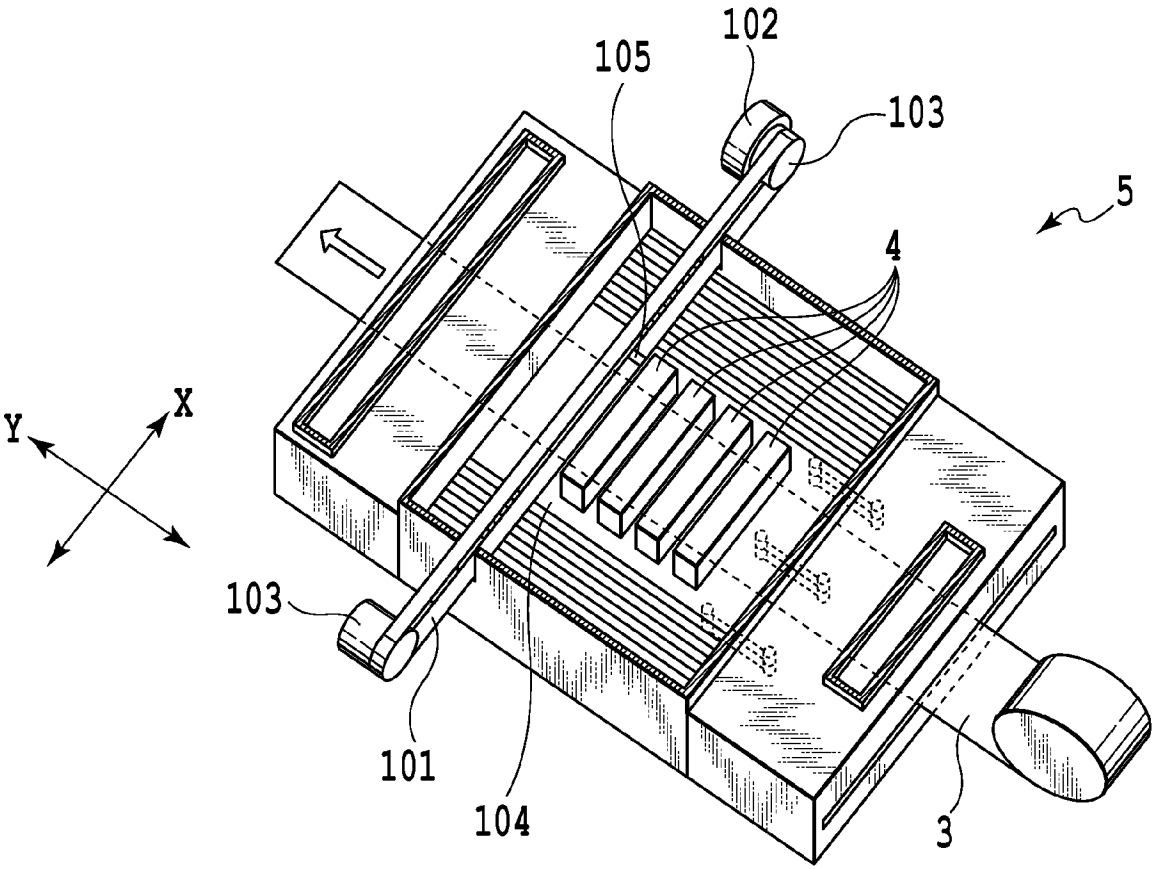
FIG. 3 is an enlarged perspective view showing the internal structure of a printing portion of the inkjet printing apparatus of FIG. 1.

FIG. 3 is an enlarged perspective view showing the detailed structure of the printing portion 5 of the printing apparatus 1. A holder 104 can move in the main scanning direction or in a direction close to the main scanning direction so as to prevent unbalance in the frequency of use of the ejection port in the print head 4. Hence, in order to move the holder 104, the printing apparatus 1 is provided with a displacement mechanism (first displacement mechanism) having a pulse motor 102, a belt 101 and a pulley 103. The holder 104 is fixed on the belt 101 at an attachment portion 105. The pulse motor 102 drives the pulley 103 attached to the belt 101. The CPU of the control portion 12 includes a print history storage portion that stores the ejection number, a printing paper width detection portion, a printing paper conveyance portion and a print head movement control portion.

Moreover, the CPU of the control portion 12 determines the region of use in the print head 9 based on the print history and printing paper width information. The print head movement control portion drives the pulse motor 102 to move the print head 4, and thus changes the ejection port to be used for the sheet. The holder 109 is configured to be able to be displaced by another displacement mechanism (second displacement mechanism) in an upward and downward direction (Z-direction) in which the print heads 9 and the sheet 3 face each other. Since the holder 104 is displaced in the Z-direction, the print head 9 can be positioned at a different height at the time of printing and maintenance operation (preliminary eject, the wiping of the ejection ports, the capping for suppressing the drying of the ejection ports and the like).

Furthermore, the holder 109 is moved in the main scanning direction, and thus the plurality of print heads 9 are moved at one time in the main scanning direction. In the present embodiment, as shown in FIG. 9, the print head 4 can be moved to a plurality of discrete positions P1, P2, P3, P4 and P5.

Next, the determination of change of the ejection port to be used on the print head 4 will be described. In the present embodiment, the average value of the accumulative ejection number from the ejection port facing the conveyance region is acquired for each of the print heads for the respective colors, and this average value of the accumulative ejection number is compared with a threshold value that is set for each of the print heads. Then, when there is a print head whose average value of the accumulative ejection number exceeds the threshold value, the position of the holder holding the print head is changed, and thus the position of the print head is changed. In this way, in the present embodiment, even when a print head of a particular color is very often used, it is possible to reduce unbalance in the use frequency of the ejection port and decrease the degradation of image quality.

Furthermore, in case that a plurality of types of inks is used, when droplets (ink) are repeatedly ejected and droplets whose ejection properties are easily changed and whose ejection properties are unlikely to be changed are present, the droplets whose ejection properties are easily changed significantly affect the reduction in the image quality due to unbalance in the use frequency. Hence, in the present embodiment, a high priority is placed on the print head ejecting the droplets whose ejection properties are easily changed, and the use frequency of the ejection port is made uniform.

Here, the change of the ejection properties of the droplets is considered to be likely caused by kogation mainly occurring on the surface of the printing element that is driven when the droplets are ejected from the ejection port. Even when the printing element is continuously driven, the degree of occurrence of kogation differs depending on the components of ink present around the printing element. That is, even when the printing element is repeatedly driven under the same circumstances, kogation easily occurs in some inks and kogation seldom occurs in the other inks, and thus the change of the properties of ink to be ejected differs.

In the present embodiment, a description will be given of the case where, when ink is repeatedly ejected, the change of ejection properties of C ink is the most significant among the four types of ink.

Figure 5:
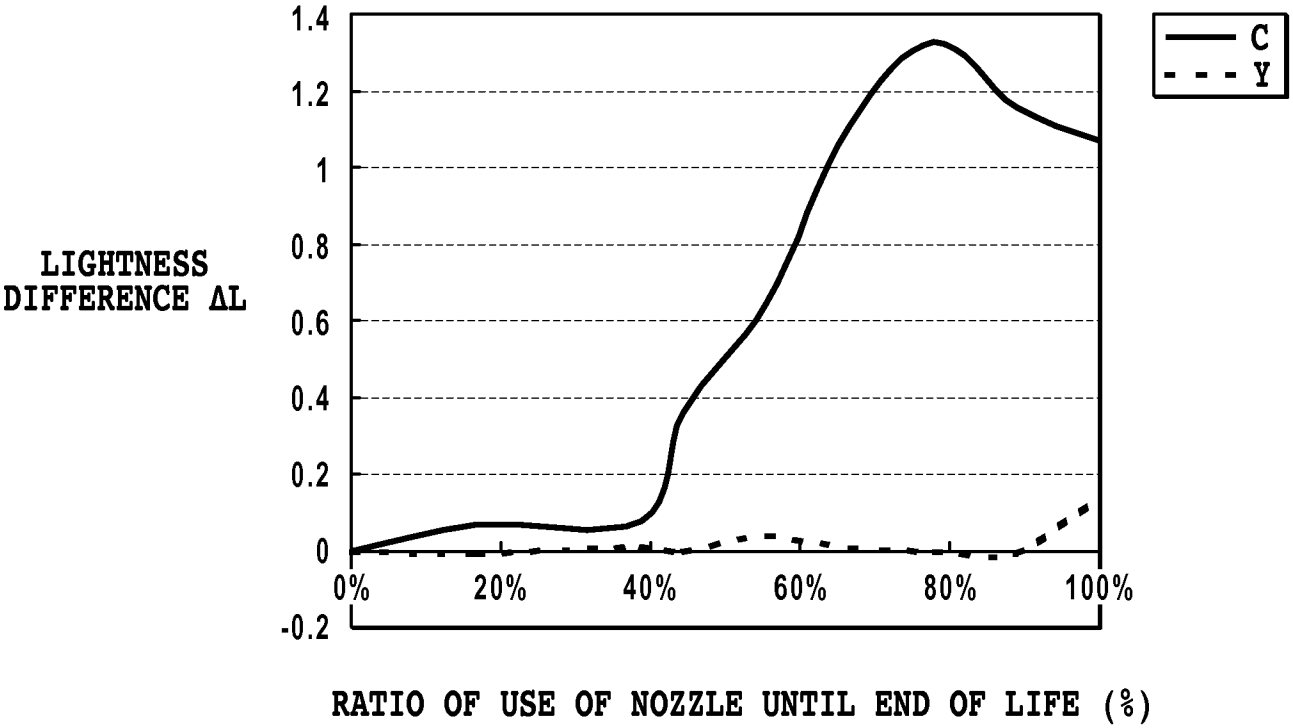
FIG. 5 is a graph showing how lightness is varied as a printing element is used from the first state of ejected ink in the inkjet printing apparatus of FIG. 1.

FIG. 5 is a graph showing variations in the properties of ejected ink when a printing element is continuously used. In FIG. 5, the horizontal axis represents a ratio of the accumulative ejection number of ink when the ratio is set to be 100% if the printing element is continuously used until the end of the life. In the graph, the vertical axis represents the difference between the lightness of ink when the use of the printing element is started and the lightness of ink which changes corresponding to the accumulative ejection number.

As shown in FIG. 5, when the printing element for ejecting C ink is used up to the accumulative ejection number corresponding to about 40% with respect to the life of the printing element, the properties of ejected droplets are relatively varied to a great extent. At the time when the accumulative ejection number corresponds to about 40% with respect to the life of the printing element, as compared with when the use of the printing element is started, the lightness difference ($\Delta L$) of a pattern printed on the print medium is relatively large. This indicates that the ejection amount of ink becomes smaller by the driving of the printing element as the accumulative ejection number is increased and thus the printing element is used for a long period of time. This is because kogation easily occurs due to a component included in the dye of C. When kogation occurs, the kogation adheres to the vicinity of the printing element, and thus the kogation inhibits the transfer of heat energy produced by the driving of the printing element, to the ink. Therefore, it is considered that, since a smaller amount of heat energy is transferred to the ink, the amount of ink to be ejected is reduced. In FIG. 5, Y ink is shown as a typical example other than C ink. As shown in FIG. 5, even when the printing element of Y ink is continuously used for a long period of time, the lightness of ink on the print medium is slightly varied accordingly.

If printing is continuously performed on a sheet having dimensions of 8 inches width using a print head having dimensions of 12 inches width without change of ejection ports being used, the amount of ink ejected differs between the ejection ports to be used and the ejection ports not to be used. In such a condition, when printing is performed on a sheet having dimensions of more than 8 inches width, a stepwise lightness difference occurs, which is recognized as an image failure.

An illustrative embodiment of the printing apparatus where the region of the ejection port being used is changed by a movement of a position of the print head 4 in the main scanning direction will be described below.

In the present embodiment, since the determination whether or not the ejection ports to be used in the print head are changed, a threshold value for the accumulative ejection number is set for each of the print heads 4. Then, at the current position, the average value of the accumulative ejection number of the ejection ports opposed to the conveyance region is calculated in each of the print head 4. When the print head where the average value of the accumulative ejection number exceeds the threshold value is present, the holder 104 is moved and thus a position of the plurality of print head 4 is changed at one tome, with the result that the ejection ports used are changed.

Figure 6:
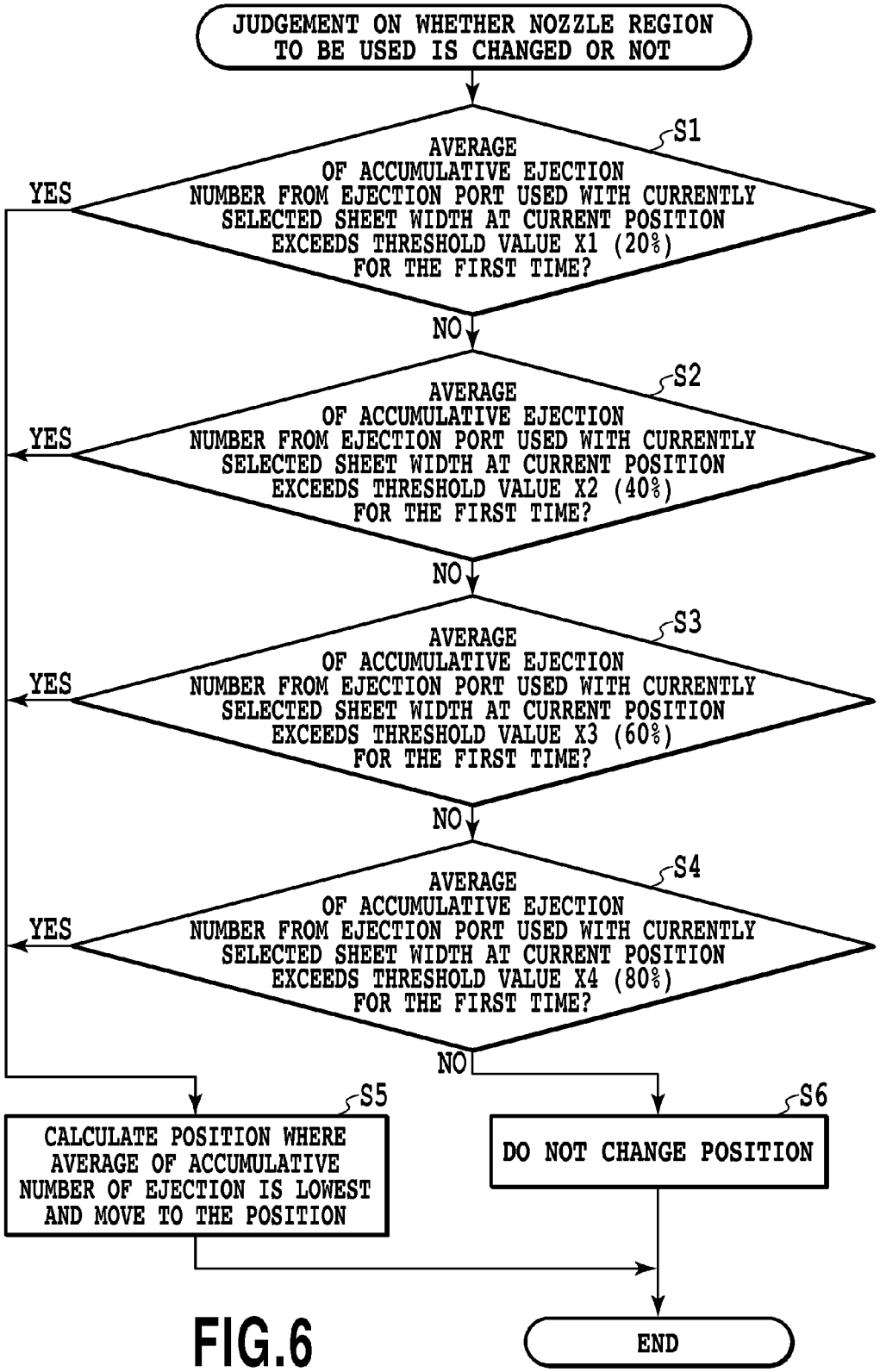
FIG. 6 is a flowchart when, in the inkjet printing apparatus of FIG. 1, for C ink, the accumulative ejection number from an ejection port within a region corresponding to a region to which a print medium is conveyed is compared with a threshold value set for each of the print heads.

FIG. 6 shows a flow for the determination of change of the ejection port to be used on the print head ejecting cyan ink. Before the flow for the determination of change of the ejection port to be used is performed, the length of the print medium in the main scanning direction is previously detected by a print medium length detection unit, and the result is input to the CPU. Then, the print history storage portion and the printing paper width detection portion of the control portion 12 are referenced. As a result of the reference, the CPU calculates, for each of the print heads 4, the average of the accumulative ejection number of the ejection port to be used for printing at the current position of the print head with respect to the length of the selected print medium in the main scanning direction. That is, with respect to the ejection port formed in a region corresponding to a region to which the print medium is conveyed, calculated from the length of the print medium in the main scanning direction detected by the print medium length detection unit, the average value of the ejection number of liquid ejected from the ejection port in the corresponding region is calculated. In the present embodiment, the CPU calculates the average value of the accumulative ejection number of liquid ejected from the ejection port formed in the region corresponding to the region to which the print medium is conveyed with respect to the corresponding region. The CPU also functions as the print medium length detection unit that detects the length of the print medium in the main scanning direction.

Then, the calculated average value of the accumulative ejection number of the ejection port opposed to a conveyance region to which the print medium is conveyed with respect to the conveyance region is compared with the threshold value set for each of the print heads. In the present embodiment, the CPU compares the average value of the accumulative ejection number with the threshold value. Here, the threshold value of the print head 4 that ejects C ink is set as the ejection number obtained by 20% increments (X1: 20%, X2: 90%, X3: 60%, X4: 80%) with respect to the life of the printing element.

Figure 4:
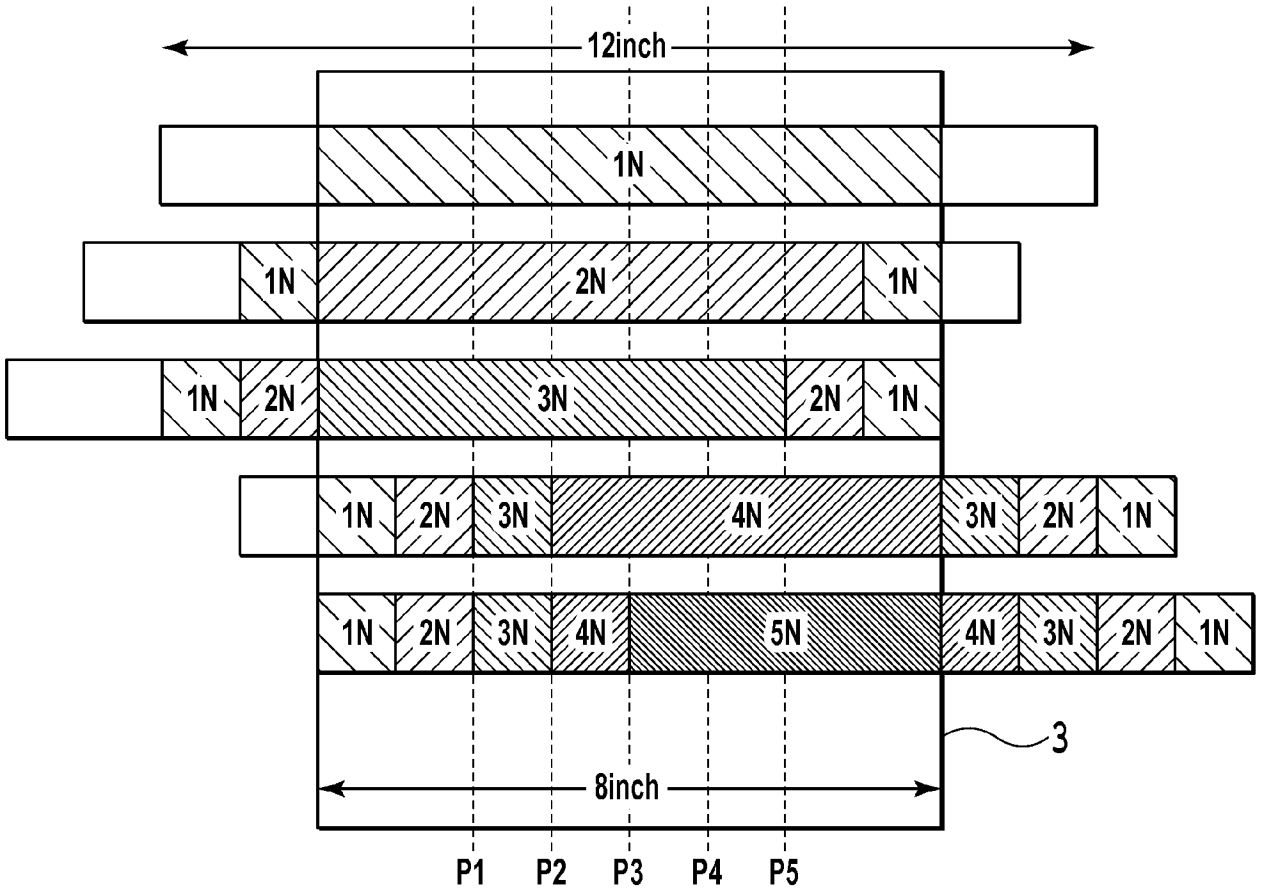
FIG. 4 is a diagram illustrating how the accumulative ejection number from ejection ports to be used as a print head of the inkjet printing apparatus of FIG. 1 moves is varied.

In the flow for the determination of change of the ejection port to be used shown in FIG. 6, a determination is first made as to whether or not the average of the accumulative ejection number at the current position exceeds X1 (20%) for the first time (S1). If X1 (20%) is exceeded for the first time, among movement positions from P1 to P5 shown in FIG. 4, the print history storage portion of the control portion 12 calculates the position where the average of the accumulative ejection number is the lowest. Then, the holder 104 moves to the position where the average of the accumulative ejection number is the lowest, and thus the region of the ejection port to be used is changed (S5). If the average of the accumulative ejection number at the current position already exceeds 20%, a determination is made as to whether or not it exceeds 40% for the first time (S2). If 40% is exceeded for the first time, among the movement positions from P1 to P5, the position where the average of the accumulative ejection number is the lowest is likewise calculated. Then, the holder 104 moves to the position where the average of the accumulative ejection number is the lowest, and thus the region of the ejection port to be used is changed (S5). Likewise, the average of the accumulative ejection number at the current position is calculated, and thus a determination is made as to whether or not the average value exceeds 60% for the first time (S3); if 60% is not exceeded, a determination is made as to whether or not the average value exceeds 80% for the first time (S4). As a result of the determination, when the print head is moved, the holder 104 is moved to the position where the average of the accumulative ejection number is the lowest within the region corresponding to the conveyance region of the print medium among the movement positions from P1 to P5. In this way, the region of the ejection port to be used on the print head is changed. If there is a plurality of positions where the average of the accumulative ejection number is the lowest, the holder 104 may be moved to any position among those positions. FIG. 4 shows an example of the movement of the position of the print head when printing is performed on a sheet of 8 inches. N represents the average of ejection number that is 20% of the limit of use of the printing element at each position when printing on the sheet of 8 inches is performed. As described above, all ejection ports are used as uniformly as possible while the print head 4 being moved, and thus the difference in a use ratio between the adjacent movement positions can be reduced at most to the accumulative ejection number that corresponds to 20% of the limit of use.

Figure 7:
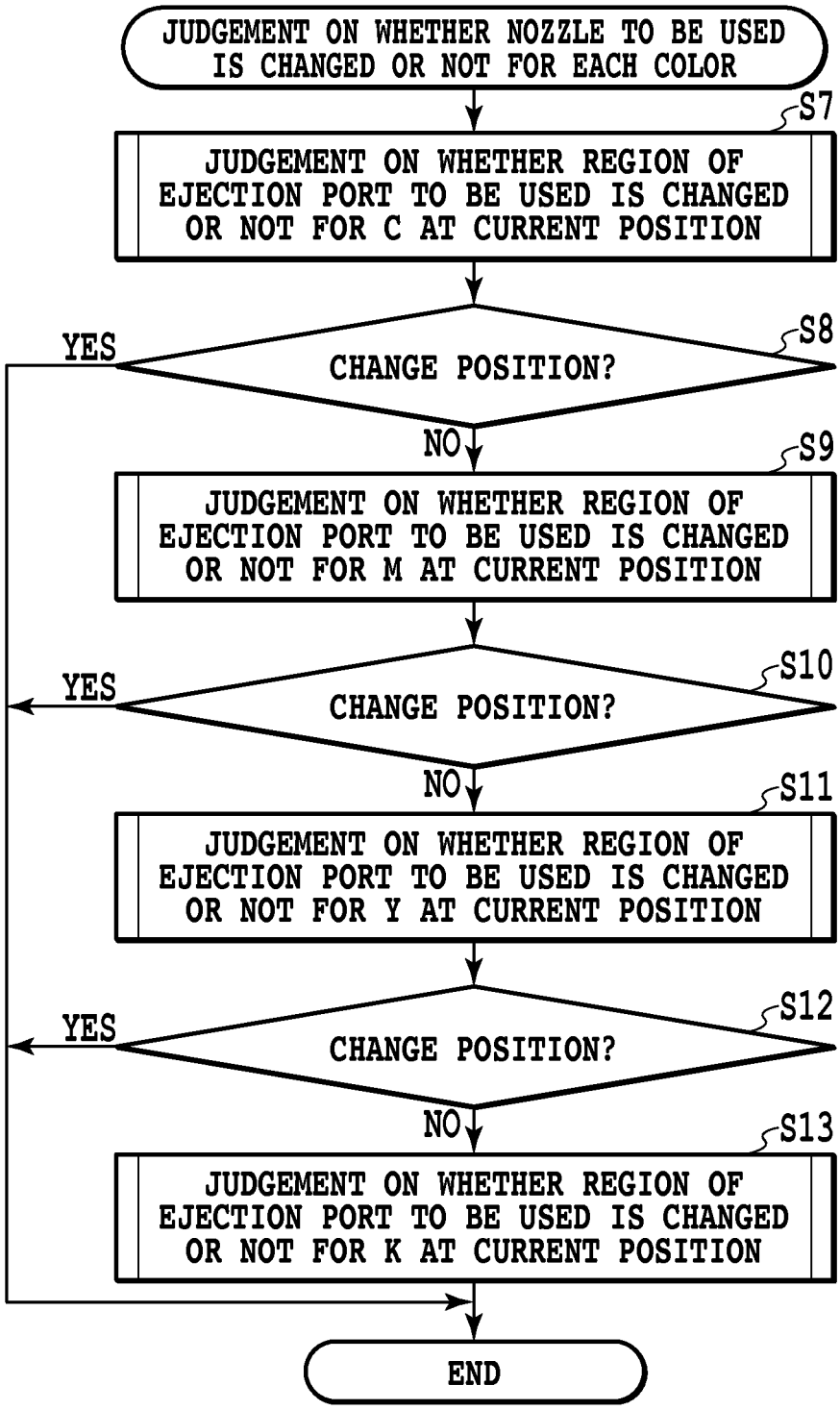
FIG. 7 is a flowchart when, in the inkjet printing apparatus of FIG. 1, a determination is made as to whether or not the region of an ejection port to be used for all print heads is changed.

Next, an order of print head where the determination of change of the region of the ejection port to be used is performed will be described with reference to FIG. 7. A determination of change of the region of the ejection port to be used for C ink is first performed among the four print heads 4. Then, a determination is made as to whether or not the region of the ejection port to be used for C ink at the current position is changed (S7). If the position for C ink is not changed (S8), a determination is made as to whether or not the region of the ejection port to be used is changed for the print head of M ink (S9). If the position of the print head 4 for M ink is not changed (S10), a determination is made as to whether or not the region of the ejection port to be used is changed for the print head of Y ink (S11). If the position of the print head for Y ink is not changed (S12), a determination is made as to the region of the ejection port to be used for the print head of K ink (S13).

Although, in the print head of each color, the flow for the determination of change of the ejection port to be used is basically the same as the flow for the print head of cyan shown in FIG. 6, the threshold value is set to be larger than that of cyan. That is, with respect to the print head of cyan, the print head 4 is moved in the main scanning direction even with a smaller number of ejections than the print heads of the other colors, and thus the print head 4 can be preferentially moved as compared with the other print heads 4.

As described above, in the present embodiment, the average value of the accumulative ejection number of the ejection port opposed to the conveyance region is acquired for each of the print heads for the respective colors, and this average value of the accumulative ejection number is compared with a threshold value that is set for each of the print heads. Then, when there is a print head whose average value of the accumulative ejection number exceeds the threshold value, the position of the holder holding the print head is changed, and thus the position of each of the print head is changed. In this way, in the present embodiment, even when a print head of a specific color is very often used, it is possible to reduce unbalance in the use frequency of the ejection port and decrease the degradation of image quality.

Moreover, in the present embodiment, the determination of change of the ejection port to be used is sequentially performed from cyan ink whose ejection properties are easily changed. In the present embodiment, when there is a print head that exceeds the threshold value, since the holder is moved and thus the positions of a plurality of print heads are changed at one time, the position of each of the print heads after the change of the position of the holder is a position in which the average of the accumulative ejection number of the print head exceeding the threshold value is lowest. In other words, although the position of the print head exceeding the threshold value is optimum for reducing the unbalance of the ejection ports to be used, it cannot be said that the positions of the print heads of the other colors are always optimum. Hence, in the present embodiment, the determination of change of the ejection port to be used is sequentially performed from cyan ink whose ejection properties are easily changed, and thus it is possible to reduce unbalance in the use frequency of the print head of the ink whose ejection properties are easily changed and decrease the degradation of image quality.

Furthermore, the threshold value for the print head of cyan is set to be lower than those for the print heads of the other colors. That is, in the print head of cyan, even with a smaller number of ejections than the print heads of the other colors, the print head 4 is moved in the main scanning direction, and can be preferentially moved as compared with the print heads 4 of the other colors. In this way, it is possible to place the highest priority on C ink whose ejection properties are significantly changed in the determination of region of the ejection port to be used.

In the present embodiment, since the position of the print head that ejects C ink is moved for each of threshold values obtained by 20% increments with respect to the limit of use, the difference of the use ratio of the ejection ports between the adjacent movement positions can be reduced to less than 20% of the limit of use. As shown in FIG. 5, within the range of up to 100% of the ratio of use when the printing element is used until the limit of use, in the difference between 0% and 80%, there is a point where the maximum lightness difference of about 1.3 is present. By contrast, at a point where the difference of ratio of use is 20%, the lightness difference is about 0.65 at most between 40% and 60%. Hence, when the present embodiment is applied, the maximum lightness difference that can occur between the adjacent regions is reduced to about half of the maximum lightness difference that can occur when the present invention is not applied. It is therefore possible to make it difficult to visually recognize a stepwise image failure in a printing image.

Although the present embodiment deals with the case where the ejection properties of C ink when ejections are repeatedly performed change most significantly, the present invention is not limited to this. Since the change of the ejection port to be used is determined with a priority assigned to each of the colors, even if the ejection properties of M ink, Y ink or K ink change, the change of the ejection port to be used can be successfully performed. Although, in that case, the priority order for the history of use of ink referenced when the change of the region of the ejection port to be used is determined is the order of C to M to Y and to K in this example, the present invention is not limited to this. Although the present embodiment deals with the example where the threshold value for C ink is set by dividing the accumulative ejection number by 20%, the present invention is not limited to this. The threshold value may be divided by other accumulative ejection number; the uniform division regarding the ejection number is not performed but a random division may be performed. Furthermore, although the present embodiment deals with the case where the print heads used in the present embodiment eject each of the four types of inks, namely, C ink, M ink, Y ink and K ink, respectively, the present invention is not limited to this combination.

Moreover, when there is a plurality of inks having the same degree of variation in the ejection properties appearing as the lightness corresponding to the ejection number, a higher priority may be placed on the determination of the region of the ejection port to be used for an ink having a low chroma, which is easily and visually recognized on an image such that the ejection is successfully performed. For example, when printing is performed using C ink and Y ink, a higher priority may be placed on C ink than on Y ink.

Although, in the determination of the region of the ejection port to be used, the average ejection number on the ejection port to be used when the width of a sheet selected at the current position is printed is calculated, the determination may be made by calculating the maximum value of the accumulative ejection number among those ejection ports.

Furthermore, although, in the present embodiment, the determination of change of the ejection port to be used is performed for the print heads of all the colors, when the ejection properties of C ink are only changed or are changed significantly as compared with other inks, no threshold value is set for the other inks, and the timing of moving the print head 4 may be determined only by the accumulative ejection number of C ink. In this case, no matter how much inks other than C ink are ejected, the position of the print head is not changed by the movement of the holder resulting from the accumulative ejection number of inks other than C ink.

Although, in the present embodiment, the movement positions of the print heads 4 are discrete, the present invention is not limited to this. A plurality of positions is not previously set; the print head may be moved to an arbitrary position such that the print medium is positioned in a region where a small number of ejections are performed with respect to the print head on which the comparison is performed with the threshold value. Moreover, when the accumulative number of ejections exceeds the threshold value and the print head is moved, the print head may be moved to the position not only where the average of the accumulative ejection number is lowest but also where the average of the accumulative ejection number does not exceed the threshold value.

Second Embodiment

Next, an inkjet printing apparatus according to a second embodiment of the present invention will be described. In the drawings, portions configured as in the first embodiment are identified with like symbols and their description will not be repeated, and different portions will only be described. The second embodiment is the same as the first embodiment in the basic configuration of the main mechanism portion of the inkjet printing apparatus and the control configuration for performing printing control on the individual portions of the printing apparatus.

In the present embodiment, the degree of variation in the ejection properties when the ejection is repeatedly performed is C>M>Y>K. In the determination of change of the ejection port to be used on the print head 4, the same threshold value is set for all types of inks, and when the average of the ejection number on the ejection port to be used for a currently selected sheet width is calculated, a coefficient by which a multiplication is performed is changed for each of the inks. As, when C is 1, M is 0.7, Y is 0.6 and K is 0.5, the coefficient by which the calculated average ejection number is multiplied is set higher for an ink having a higher degree of variation in the ejection properties. The coefficient set as described above is multiplied by the ejection number, and weighting is performed on the ejection number according to the type of ink. In the present embodiment, the inkjet printing apparatus includes an ink ejection number weighting unit (liquid ejection number weighting unit) that calculates the weighted ejection number of ink by multiplying the ejection number of ink counted with an ejection number count unit by the set coefficient.

In this way, it is possible to set the priority order for the determination of change of the ejection port to be used, by the coefficient by which the average of the ejection number is multiplied, according to the ease of variation in the properties of ink ejected from the print head. The flows for the determination of change of the ejection port to be used and the determination of change of the region of the ejection port to be used for each of the colors are the same as in the first embodiment.

In the first and second embodiments, in the threshold value determination, the average value of the ejection number on the ejection port to be used when the sheet width selected at the current position is printed is calculated, and this average value is compared with the threshold value. However, the maximum value of the accumulative ejection number of the ejection port formed in the region corresponding to the region to which the print medium is conveyed is calculated, and the maximum value may be used for the comparison with the threshold value. Although the coefficient by which the calculated ejection number is multiplied is increased for the ink having a higher degree of variation in the ejection properties when the ejection is repeatedly performed, when the degree of variation in the ejection properties is about the same, the coefficient by which the ink having a low chroma is multiplied may be increased.

Alternatively, although, in the first and second embodiments, in order to change the range of use of the ejection ports in the print heads, the holder with a plurality of print heads is moved, the present invention is not limited to this mechanism.

For example, with the position of the print heads fixed, the position of the print medium (sheet) to be conveyed is changed to the direction in which the nozzle arrays are arranged, and thus the range of use of each of the print heads may differ. In any event, in the present invention, any configuration may be used as long as the relative positional relationship between the print heads and the print medium in the direction in which the nozzle arrays are arranged can be changed. In addition, the present invention is not limited to the case where the ejection number of the print head is counted and accumulation per one nozzle is conducted. The ejection number may be counted and accumulated in units of a plurality of nozzles.

While the preset invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-128047, filed Jun. 3, 2010, which is hereby incorporated by reference herein in its entirety.

What is claimed is:

1. An inkjet printing apparatus comprising:

a plurality of print heads each including an ejection port array comprising a plurality of ejection ports arranged in a crossing direction, crossing a conveyance direction of a print medium, the plurality of print heads are constructed to eject ink from the ejection ports, wherein the plurality of print heads include a first print head constructed to eject a first ink of a first color and a second print head constructed to eject a second ink of a second color that is a different color from the first color, wherein the first print head and the second print head are arranged in the conveyance direction, and wherein a degree of variation of an amount of first ink ejected by the first print head with respect to a predetermined accumulative ejection amount for the first print head is larger than a degree of variation of an amount of second ink ejected by the second print head with respect to the predetermined accumulative ejection amount for the second print head; and a print control unit configured to cause the first print head and the second print head to print an image on a print medium using ejection ports of the first print head and the second print head located within a common predetermined range in the crossing direction, while the print medium is conveyed in the conveyance direction, wherein the print control unit is further configured to acquire information about an accumulative ink ejection number for the first print head and an accumulative ink ejection number for the second print head, and wherein in a case where (i) the accumulative ink ejection number for the first print head, indicated by the acquired information, is larger than a first threshold of ink ejection number set for the first print head, the first threshold of ink ejection number being set based on the degree of variation of an amount of first ink ejected by the first print head, the print control unit changes the common predetermined range based on the acquired information and in a case where (ii) the accumulative ink ejection number for the first print head, indicated by the acquired information, is not larger than the first threshold of ink ejection number set for the first print head, and the accumulative ink ejection number for the second print head, indicated by the acquired information, is greater than a second threshold of ink ejection number set for the second print head, the second threshold of ink ejection number being set based on the degree of variation of an amount of second ink ejected by the second print head, the print control unit changes the common predetermined range based on the acquired information, wherein the first threshold of ink ejection number is smaller than the second threshold of ink ejection number.

2. The ink jet printing apparatus according to claim 1, wherein the print control unit changes the common predetermined range of the first print head and the second print head by moving the first print head and the second print head in the crossing direction.

3. The ink jet printing apparatus according to claim 1, wherein lengths of the ejection port arrays in the crossing direction are greater than a length of the printing medium in the crossing direction, and wherein a length of the common predetermined range in the crossing direction corresponds to the length of the print medium in the crossing direction.

4. The ink jet printing apparatus according to claim 1, wherein the plurality of print heads eject ink from their respective ejection ports by transmitting heat energy to the respective inks.

5. The ink jet printing apparatus according to claim 1, wherein the print control unit performs a judgment of whether the accumulative ink ejection number for the first print head and the accumulative ink ejection number for the second print head, indicated by the acquired information, exceed the respective thresholds set for the first print head and the second print head, wherein the print control unit changes the common predetermined range based on the judgment, wherein the print control unit performs the judgment of whether the accumulative ink ejection number in the first print head is greater than or less than the threshold set for the first print head, and wherein the print control unit performs the judgment of whether the accumulative ink ejection number in the second print head is greater than or less than the threshold set for the second print head, in a case where it is judged that the accumulative ink ejection number for the first print head is less than the threshold set for the first print head.

6. The ink jet printing apparatus according to claim 1, wherein the print control unit changes the common predetermined range such that an accumulative ink ejection number of an ejection port formed in a range corresponding to where the print medium is conveyed becomes a lowest number of the accumulative ink ejection numbers, in a case where the accumulative ink ejection number indicated by the acquired information is greater than the threshold in the print head.

7. The ink jet printing apparatus according to claim 1, further comprising:

a print medium length detection unit configured to detect a length of the print medium in the crossing direction, wherein the print control unit acquires information with respect to an average value or a maximal value of ink ejection numbers, as the information, ejected from the ejection ports formed in an area corresponding to where the print medium is conveyed based on the length of the print medium in the crossing direction detected by the print medium length detection unit.

8. The ink jet printing apparatus according to claim 1, wherein the print control unit counts respective numbers of ink ejections from each of the first print head and the second print head, wherein the print control unit acquires a number, as the information, by multiplying a coefficient set for the first print head and a coefficient set for the second print head by the numbers of ink ejections for the first print head and the second print head, respectively, and wherein the coefficient for the first print head is greater than the coefficient for the second print head.

9. The ink jet printing apparatus according to claim 1, wherein the accumulative ink ejection numbers are counted from beginning of use.

10. The ink jet printing apparatus according to claim 1, wherein the first color is cyan, and the second color is one color selected from magenta, yellow and black.

11. The ink jet printing apparatus according to claim 1, wherein a degree of variation of an amount of first ink ejected by the first print head with respect to the first threshold of ink ejection number is larger than a degree of variation of an amount of second ink ejected by the second print head with respect to the first threshold of ink ejection number.

12. An inkjet printing apparatus comprising:

a plurality of print heads each including an ejection port array comprising a plurality of ejection ports arranged in a crossing direction, crossing a conveyance direction of a print medium, and a plurality of elements configured to generate heat to eject ink, the plurality of print heads are constructed to eject ink from the plurality of ejection ports by use of heat generated by the plurality of elements, wherein the plurality of print heads include a first print head constructed to eject a first ink of first color and a second print head constructed to eject a second ink of a second color that is a different color from the first color, wherein the first print head and the second print head are arranged in the conveyance direction, and wherein kogation by heat occurs more easily in the first ink than the second ink, the kogation causing a degree of variation of an amount of first ink ejected by the first print head with respect to a predetermined accumulative ejection amount for the first print head to be larger than a degree of variation of an amount of second ink ejected by the second print head with respect to the predetermined accumulative ejection amount for the second print head; and a print control unit configured to cause the first print head and the second print head to print an image on a print medium using ejection ports of the first print head and the second print head located within a common predetermined range in the crossing direction, while the print medium is conveyed in the conveyance direction, wherein the print control unit is further configured to acquire information about an accumulative ink ejection number for the first print head and an accumulative ink ejection number for the second print head, and wherein in a case where (i) the accumulative ink ejection number for the first print head, indicated by the acquired information, is larger than a first threshold of ink ejection number set for the first print head, the first threshold of ink ejection number being set based on the degree of variation of an amount of first ink ejected by the first print head, the print control unit changes the common predetermined range based on the acquired information and in a case where (ii) the accumulative ink ejection number for the first print head, indicated by the acquired information, is not larger than the first threshold of ink ejection number set for the first print head and the accumulative ink ejection number for the second print head, indicated by the acquired information is greater than a second threshold of ink ejection number set for the second print head, the second threshold of ink ejection number being set based on the degree of variation of an amount of second ink ejected by the second print head, the print control unit changes the common predetermined range based on the acquired information, wherein the first threshold of ink ejection number is smaller than the second threshold of ink ejection number.

13. The ink jet printing apparatus according to claim 12, wherein the first color is cyan, and the second color is one color selected from magenta, yellow and black.

14. An inkjet printing apparatus comprising:

a plurality of print heads each including an ejection port array comprising a plurality of ejection ports arranged in a crossing direction, crossing a conveyance direction of a print medium, the plurality of print heads are constructed to eject ink from the ejection ports, wherein the plurality of print heads include a first print head constructed to eject a first ink of first color and a second print head constructed to eject a second ink of a second color that is a different color from the first color, wherein the first print head and the second print head are arranged in the conveyance direction, and wherein a degree of variation of an amount of first ink ejected by the first print head with respect to a predetermined accumulative ejection amount for the first print head is larger than a degree of variation of an amount of ink ejected by the second print head with respect to a predetermined accumulative ejection amount for the second print head; and a print control unit configured to cause the first print head and the second print head to print an image on a print medium using ejection ports of the first print head and the second print head located within a common predetermined range in the crossing direction, while the print medium is conveyed in the conveyance direction, wherein the print control unit is further configured to acquire information about an accumulative ink ejection number for the first print head and an accumulative ink ejection number for the second print head, and wherein the print control unit performs a judgment on whether the accumulative ink ejection number in the first print head is greater than or not greater than the threshold set for the first print head, and in a case where (i) it is judged that the accumulative ink ejection number for the first print head, indicated by the acquired information, is larger than a first threshold of ink ejection number set for the first print head, the first threshold of ink ejection number being set based on the degree of variation of an amount of first ink ejected by the first print head, the print control unit determines to change the common predetermined range based on the acquired information, and in a case where (ii) it is judged that the accumulative ink ejection number for the first print head, indicated by the acquired information, is not greater than the first threshold of ink ejection number set for the first print head, the print control unit performs a judgment on whether the accumulative ink ejection number in the second print head is greater than or not greater than the second threshold of ink ejection number set for the second print head.

15. The ink jet printing apparatus according to claim 14, wherein the first color is cyan, and the second color is one color selected from magenta, yellow and black.

* * * * *